US008578751B2

(12) United States Patent
Hofmann

(10) Patent No.: US 8,578,751 B2
(45) Date of Patent: Nov. 12, 2013

(54) TOOL WITH DIFFERENT EFFECTIVE AREAS

(75) Inventor: Frank Hofmann, Attendorn (DE)

(73) Assignee: Viega GmbH & Co. KG, Attendorn (DE)

( * ) Notice: Subject to any disclaimer, the term of this patent is extended or adjusted under 35 U.S.C. 154(b) by 17 days.

(21) Appl. No.: 13/289,583

(22) Filed: Nov. 4, 2011

(65) Prior Publication Data

US 2012/0279276 A1 Nov. 8, 2012

(30) Foreign Application Priority Data

Nov. 5, 2010 (DE) ..... 10 2010 050 320

(51) Int. Cl.
*B21D 37/14* (2006.01)
*H01R 43/042* (2006.01)
*B21D 7/06* (2006.01)

(52) U.S. Cl.
USPC ..... 72/409.16; 72/409.11; 72/413; 72/416; 81/422; 81/423; 29/751

(58) Field of Classification Search
USPC ..... 72/409.1, 409.11, 409.16, 413, 416, 72/482.91, 482.92; 81/416, 421–423; 29/750, 751, 753
See application file for complete search history.

(56) References Cited

U.S. PATENT DOCUMENTS

| | | | | |
|---|---|---|---|---|
| 6,101,862 | A * | 8/2000 | Rzasa et al. | 72/413 |
| 7,350,393 | B2 * | 4/2008 | Li | 72/409.16 |
| 7,536,896 | B1 * | 5/2009 | Hung | 72/409.16 |
| 7,665,343 | B2 | 2/2010 | Ballas et al. | |
| 7,882,722 | B2 * | 2/2011 | Lefavour et al. | 72/416 |
| 8,069,700 | B2 * | 12/2011 | Liao | 72/409.16 |
| 2011/0057372 | A1 | 3/2011 | Neubauer | |

FOREIGN PATENT DOCUMENTS

| | | | |
|---|---|---|---|
| DE | 102008011220 | B3 | 4/2009 |
| DE | 202009006823 | U1 | 11/2009 |

* cited by examiner

*Primary Examiner* — David B Jones
(74) *Attorney, Agent, or Firm* — The Webb Law Firm

(57) ABSTRACT

The invention relates to a tool for processing a workpiece in particular for pressing, holding and/or cutting a pipe, having a first pair of jaws which has a first upper jaw and a first lower jaw, having a first effective area formed between the front ends of the first jaws, having a first inlet contour formed between the rear ends of the first jaws and having a holding device which movably accommodates the first jaws independent of one another, wherein the first jaws can be pivoted between an open position and a closed position. The present invention is based on the technical problem of specifying a tool, by means of which in one process at least one first and one second effect can be assigned to the tool independently from one another in time.

15 Claims, 9 Drawing Sheets

TOOL WITH DIFFERENT EFFECTIVE AREAS

The invention relates to a tool for processing a workpiece in particular for pressing, holding and/or cutting a pipe, having a first pair of jaws which has a first upper jaw and a first lower jaw, having a first effective area formed between the front ends of the first jaws, having a first inlet contour formed between the rear ends of the first jaws and having a holding device which movably accommodates the first jaws independent of one another, wherein the first jaws can be pivoted between an open position and a closed position.

Tools of the kind mentioned at the outset are known in the prior art and are used, for example, in the drinking water or heating installation sectors, in order to press pipes together during installation, where appropriate via fittings or using corresponding mountings or couplings. Pipes and fittings suitable for this purpose are also known from the prior art. A so-called press is often used here, onto which a tool is attached and which essentially pushes a bolt between the rear ends of the jaws of the tool along the inlet contour, in order to close the front ends of the jaws. Here, the workpiece lies between the jaws of the tool and is pressed. It should be noted that even when workpiece is mentioned in what follows, more than one workpiece can always also be meant. Thus, for example, two pipes which are connected via a fitting.

In such a pressing process, a connection is often to be created which is not only sufficiently tightly sealed in relation to the media conveyed by the pipe but is also, at the same time, sufficiently mechanically durable, so that the connection does not loosen under potential loads, for example by thermal expansion. If, furthermore, the pipes are to be pressed over a wider area or the pipes to be pressed have a wide diameter, the problem also quickly arises that a greater exertion of force is required and, for example, presses reach their maximum capacity correspondingly more quickly. However, multiple pressing here is laborious and does not produce reliable results.

Furthermore, it is often necessary to cut workpieces to length on site before they can be installed as pipes. This can take place by the fixed workpiece being cut by means of a cutting-off wheel, a pipe cutter or a saw. However, this is laborious and time-consuming. Here, different effects also have to be assigned to a workpiece offset in time, since the workpiece firstly has to be fixed and then cut to length.

Taking this prior art as the starting point, the invention is based on the technical problem of specifying a tool, by means of which in one process at least one first and one second effect can be assigned to the tool independently of one another in time.

The technical problem is solved by the tool mentioned at the outset being characterised in that a second pair of jaws is provided which has a second upper jaw and a second lower jaw, in that a second effective area is formed between the front ends of the second jaws, in that a second inlet contour is formed between the rear ends of the second jaws, in that the holding device movably accommodates the second jaws independent of one another and independent of the first jaws, in that the second jaws can be pivoted between an open position and a closed position, and in that the first inlet contour and the second inlet contour are formed differently.

A second effective area, which is independent of the first effective area, is created by the second pair of jaws. Since the second jaws can be opened and closed independently of the first pair of jaws and the inlet contours of the pairs of jaws are formed differently, a first and second effect, for example, can be offset in time. In this way, the available power of a press can be utilised in an optimal way, since now two different places on a workpiece can be pressed in succession and the power for processing the whole workpiece does not have to be applied all at once. It is also possible, in this way, to adapt the transmission of force from the bolt by means of the jaws to the workpiece, both with regard to the amount of force and with regard to the progression of the force over time, individually for each effective area, since, for example, holding a workpiece does not require as much force as cutting through the same.

A further embodiment of the tool according to the invention is characterised in that the first effective contour and the second effective contour are formed differently. Different effects can thereby be assigned to the workpiece in one process.

It is possible to exert a pressing effect on the workpiece from both jaws. Owing to the independent formation of the jaw pairs, both jaws can now press the workpiece or the workpieces by means of different effective contours. The problem mentioned above of pressing a pipe and a fitting satisfactorily both with respect to the seal tightness and with respect to the mechanical durability, can thereby be solved, since for each area an optimum effective contour corresponding to the task can be found.

It is also possible to design the effective contours in such a way that the workpiece, for example a pipe or a rod, is held by the first pair of jaws and cut through by the second pair of jaws, wherein the workpiece is preferably held before it is cut through. Hence, this embodiment implements a tool for fixing and cutting through a workpiece, which is an alternative to a saw.

In addition to that, any further combination of effective contours is also possible. Thus, the workpiece can, for example, be both held and pressed or pressed and cut through or cut through twice using a tool according to the invention. The effects mentioned here should also not be understood as an exclusive list. The effect can, for example, also consist of slitting the workpiece slightly, partially cutting through the workpiece, deforming or impressing the workpiece. Owing to the arbitrarily alterable inlet contours, it is possible to produce any fine graduations in the effect when the workpiece is being held, for example. Thus, by applying a slightly greater force on the workpiece by means of the jaws, the tool can also be clamped, which in turn by applying still greater force would continually be converted into pressing. The effect of a pair of jaws could also depend on operating or triggering a switch.

Of course, this variety of processing options means that it is also possible to process, such as cut to length, not only pipes or rods but also workpieces such as cables using a tool according to the invention.

Preferably, the pairs of jaws are arranged offset relative to each other. In this way, effects can be performed on areas of a workpiece to be inserted which are located as close to one another as desired.

In a further embodiment of the tool according to the invention, the holding device has at least two pins, wherein the first pin is the common pivot pin for the upper jaws and the second pin is the common pivot pin for the lower jaws. As a result, on the one hand, the tool can be compactly constructed and, on the other hand, most of the workpieces to be processed, such as pipes, fittings or rods, at least over the effective area, have only slight variations, for example their radius, so that the upper and lower pressing jaws can share a pivot pin. Furthermore, by using two pivot pins instead of one, a shear movement is reduced and a press can be used which closes the front ends by pressing the rear ends of the jaws apart.

It is, furthermore, possible for at least one pair of jaws to be arranged integrally with an effective contour. In this way, production of the pair of jaws can be significantly simplified and arranged more economically and easily. The tool itself is thereby also significantly simplified and is less fault-prone.

A further embodiment of the tool according to the invention is characterised in that a third pair of jaws is provided which has a third upper jaw and a third lower jaw, in that a third effective area is formed between the front ends of the third jaws, in that a third inlet contour is formed between the rear ends of the third jaws, in that the holding device movably accommodates the third jaws independent of one another and independent of the first jaws and the second jaws, in that the third jaws can be pivoted between an open position and a closed position, and in that the third inlet contour is formed differently from the first inlet contour and/or from the second inlet contour, and in that the second pair of jaws is arranged between the first pair of jaws and the third pair of jaws. In this way, up to three different effective areas are defined, the effective contours of which and hence the effects of which can be applied independently of one another. Furthermore, the time progression and the transmission of the force can be influenced for the pairs of jaws, or even for each jaw, by the independent formation of the inlet contours.

Preferably, in each case the first upper jaw and third upper jaw and first lower jaw and third lower jaw are fixedly connected to one another via connecting elements. As a result, the tool is more stable and the corresponding upper and lower jaws can be guided simultaneously, irrespective of how the bolt presses the inlet contours of the first and third jaws apart.

Preferably, in this case, the first pair of jaws and the third pair of jaws also have the same inlet contour. This has the advantage that the jaws can also be closed at the same time via the inlet contour and the force from the bolt is also transmitted essentially evenly to the first and the third jaws.

In a further embodiment of the tool according to the invention, at least four tool elements are provided, wherein in each case a front tool element and a rear tool element are in contact with the second upper jaw and in each case a front tool element and a rear tool element are in contact with the second lower jaw. At the same time, the tool elements take part in the movement of the second jaws.

By introducing the movable tool elements, the processing operation can be optimised further. The second effective contour is, in this case, defined by the tool elements. In this way, the properties of the tool elements can be adapted to the workpiece to be processed, without having to modify the whole jaw. These properties can, for example, be the shape or the material of the tool elements. This, amongst other things, has an economic impact on production, since only the tool elements have to consist of a certain material or be tempered, and not the whole jaw. It is also possible for the tool to be used in a flexible manner by just exchanging the tool elements. The tool elements can, independently from one another, like the jaws take on the function of a pressing, holding or cutting tool element. The functions of the tool elements are, however, not restricted to the above.

If the tool has tool elements, it is advantageous if the first jaws and/or third jaws have holders for the tool elements, wherein the tool elements can move relative to the jaws and relative to one another. In order to guarantee a predefined movement of the tool elements, the tool elements are restricted in their movement by holders in the jaws surrounding the tool elements. These holders can, for example, be in the form of slots, in which the tool elements partly engage and which form a guide rail for the tool elements. In addition, it is preferred if the tool elements are pre-tensioned by means of springs which keep the upper tool elements in contact with the second upper jaw and the lower tool elements in contact with the second lower jaw. The tool elements are only moved in the direction of the workpiece to be processed by the pressure of the second jaws on the tool elements. In this way, the tool elements through constant contact follow the movement of the jaws and thus take part in the movement of the second jaws.

Preferably, at least one second jaw has at least one bump, preferably one bump for each tool element. By suitably forming and arranging the bumps, on the one hand, the pressing behaviour relating to time and, on the other hand, combined with the holders for the tool elements, the direction of the force, by means of which the elements act on the workpiece, can be altered.

Preferably, the bumps of the second jaws apply pressure to the tool elements at essentially the same time. The original shear movement, which is present due to the tool arrangement according to the invention, can thereby be counteracted. This is because, owing to the shear movement when the jaws are closed, the area of the workpiece which is positioned nearer to the pivot pins comes into contact first with the effective contour and only subsequently the area of the workpiece which is further away from the pivot pin. By means of a configuration according to the invention, it is, however, possible to adjust the time sequence of the effect of the tool elements and, in particular, for all tool elements to act on the workpiece essentially at the same time.

A further embodiment of the tool according to the invention is characterised in that at least one effective contour is a pressing contour. As already stated at the outset, by configuring the effective contours as pressing contours, pressing, for example pipes with fittings, is made possible. Now, for mechanical durability, for example with the first jaw pair, a hexagonal shape can be chosen as the pressing contour. This contour has a positive effect on mechanical durability compared to a cylindrical pressing contour. With such a pressing operation, sealing rings are often inserted to seal between the components to be connected. Pressing with the same hexagonal pressing contour would, however, here have a negative effect on the seal tightness. Hence, the area with the sealing ring is pressed with a cylindrical pressing contour with the second pair of jaws. In this way, both mechanical durability and seal tightness can be catered for. In the preceding example, all effective contours are formed as pressing contours. It is, however, also possible for the effective contours to have different effects, for example holding the workpiece with subsequent pressing. The effective contours specified here are also only to be taken as examples, since other effective contours, for example oval, polygonal or irregular effective contours, can also be provided.

In a subsequent embodiment of the tool according to the invention, at least one effective contour is a holding contour and at least one effective contour is a cutting contour. In this way, the workpiece can be cut to length quickly, simply and in a way which saves on space, and the workpiece does not have to be initially fixed and then cut through using a saw. Here, it is particularly preferred if cutting begins only when the workpiece is already held and hence fixed. The workpiece can be held by the effective contour essentially corresponding to the circumferential contour of the workpiece and this workpiece being held frictionally engaged by the tool. In addition, the workpiece, for example a round pipe, is as a result not pressed into an oval shape, for example, by the cutting elements during the cutting process, since it is held by the holding contour in the original shape.

It is preferred if at least two effective contours are identical. It is preferred even more if the first and third effective contours are identical. In this way, for example, the workpiece is symmetrically pressed. Referred to the above examples, optimum seal tightness can be provided in plane B by cylindrically pressing a pipe by means of the second contour and mechanical durability can be provided by two hexagonal pressing operations on both sides. It is also preferred in the case of using the tool for holding and cutting if the tool is cut with the second effective contour and is held with the first and third jaws, so that the workpiece is fixed on both sides and deformations are prevented on both sides.

It is furthermore made clear that the invention is not restricted to the use of two or three pairs of jaws. It is also conceivable for four or even more pairs of jaws to be used, in which the effective contours can occur in any combination. In each case, however, two pairs of jaws are present according to the teaching according to the invention. In this context, the indications regarding the number of jaws can be understood as the minimum number. The tool must, therefore, have at least one second pair of jaws, in order to be able to carry out the teaching according to the invention. For better readability, however, as far as possible the use of "at least" in connection with the number of jaws is dispensed with.

It is furthermore made clear that the configuration of the effective contours is not only restricted to the configuration of the circumferential shape of the effective contours (for example, cylindrical or hexagonal during pressing) but the effective contours can also have fluting or ribbing which is longitudinal or transverse to the pivoting planes.

The invention is explained in more detail below with the aid of exemplary embodiments illustrated in the figures.

Figure 1:
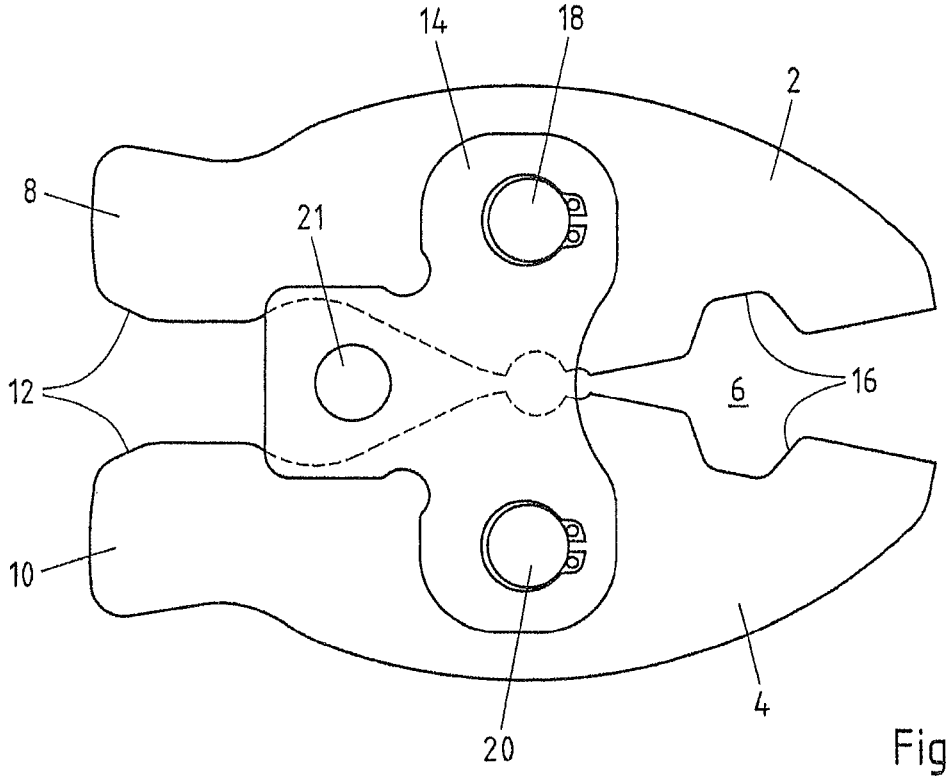
FIG. 1 shows a first pair of jaws in the open state in a side view.
Figure 2:
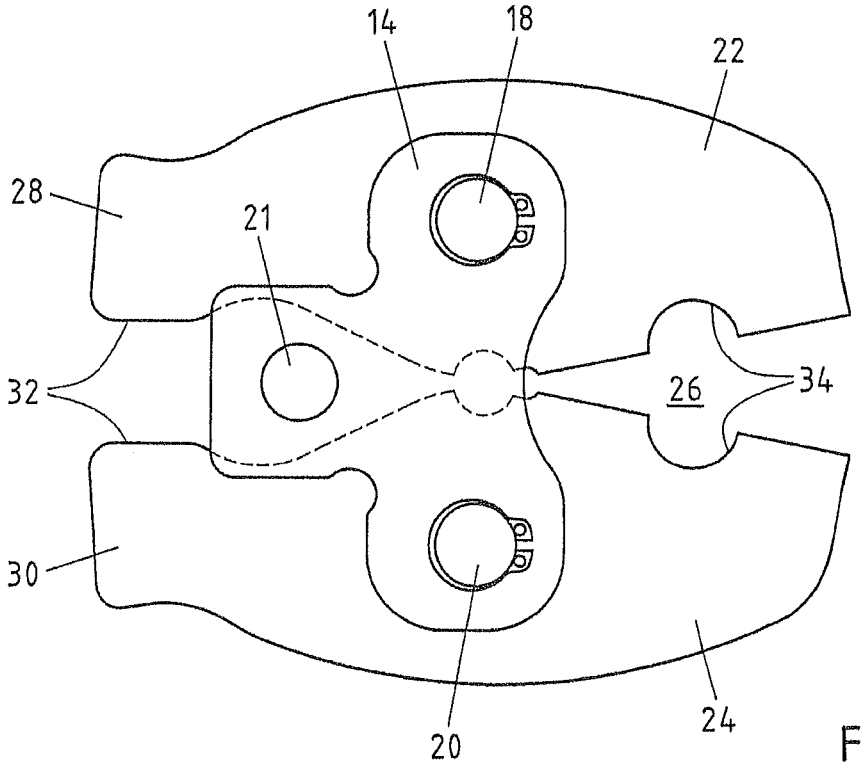
FIG. 2 shows a second pair of jaws in the open state in a side view.
Figure 3:
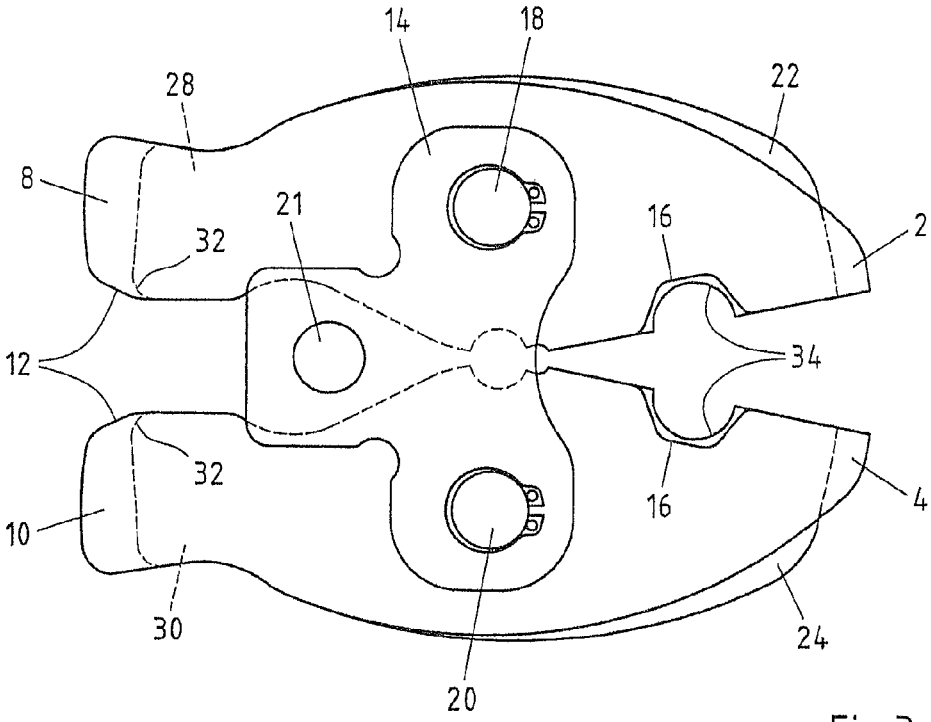
Figure 4:
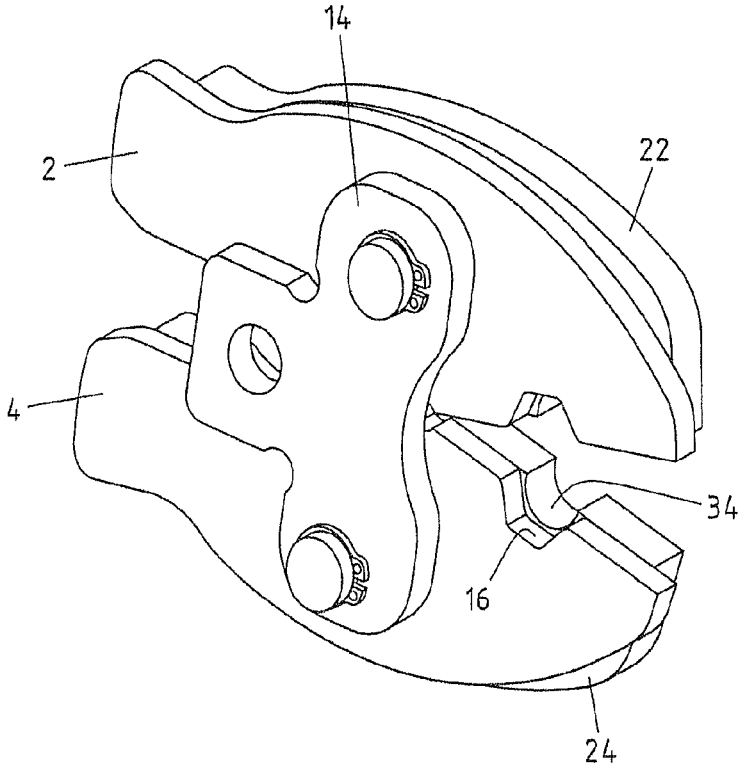
Figure 5:
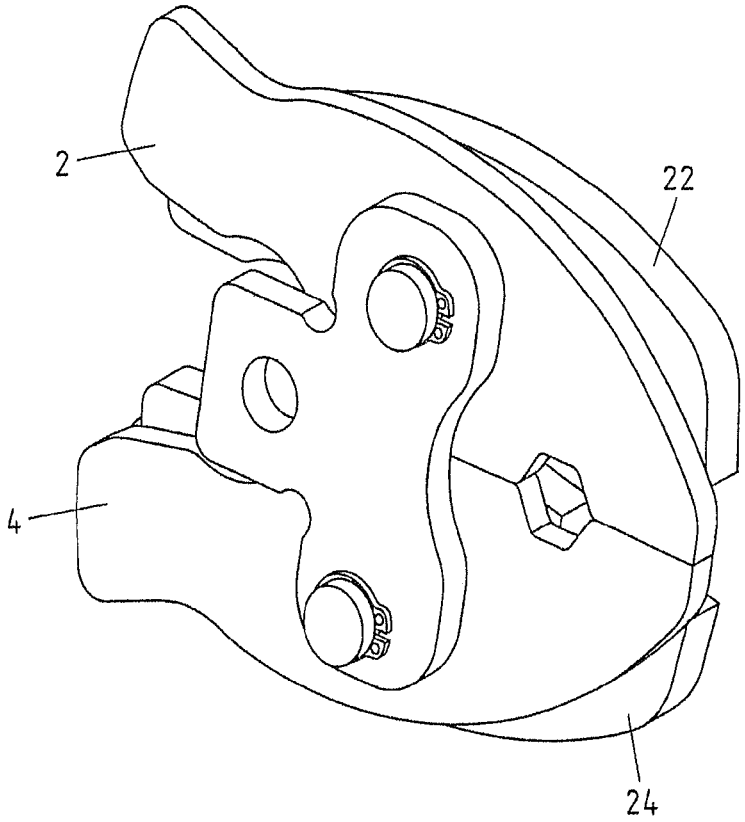
Figure 6:
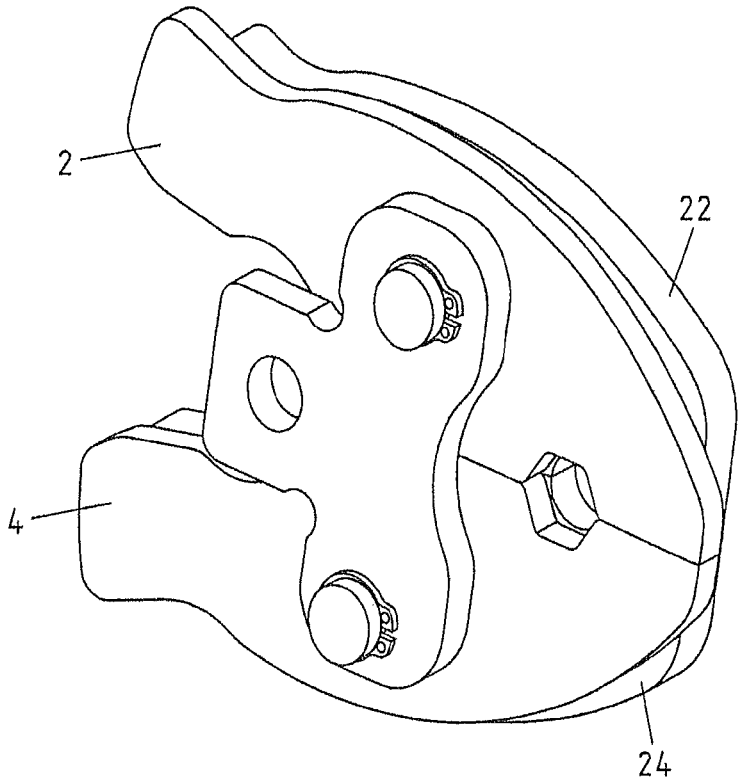
Figure 7:
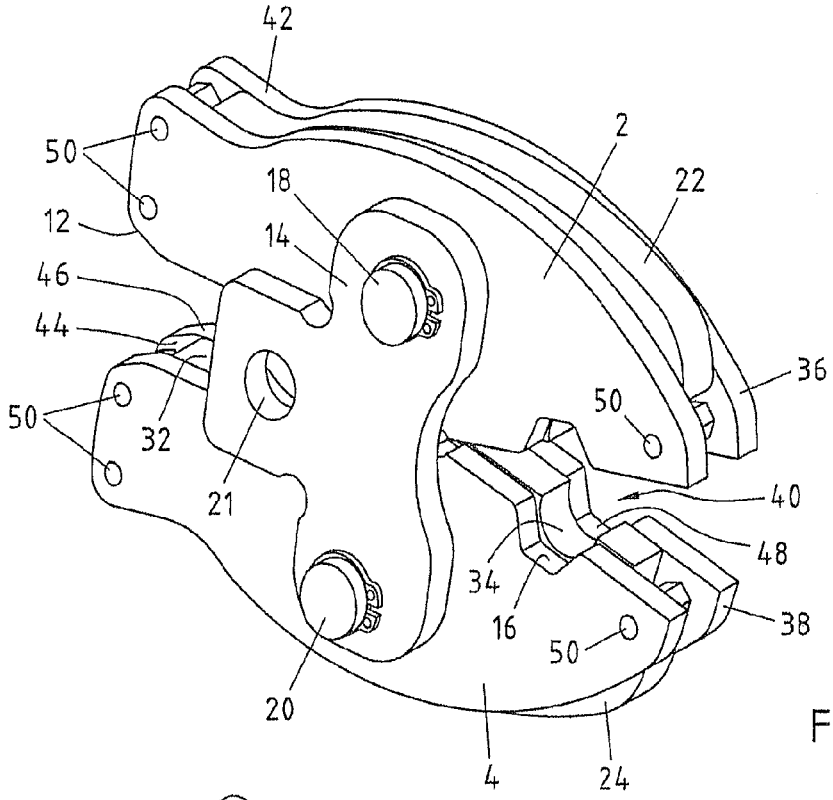
Figure 8:
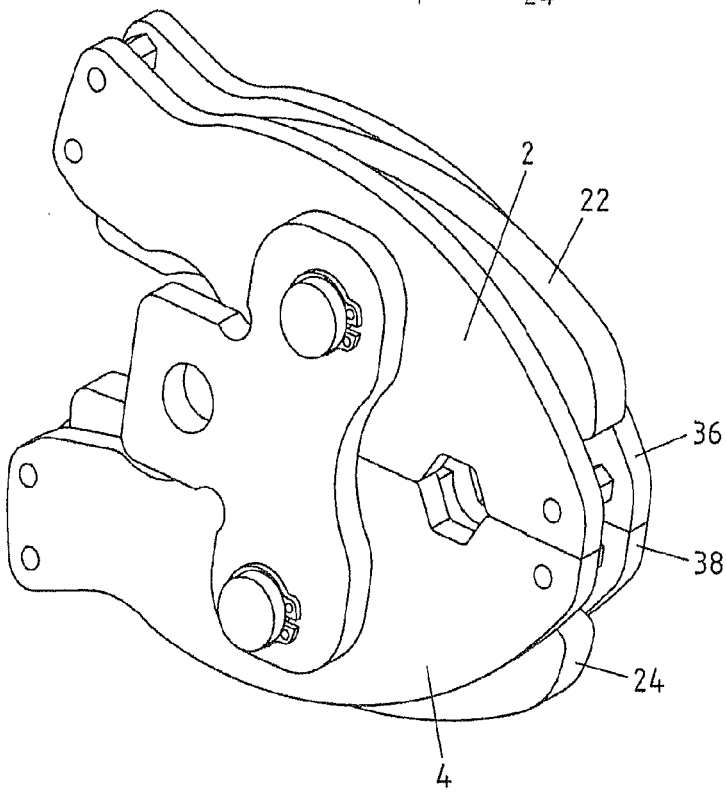
Figure 9:
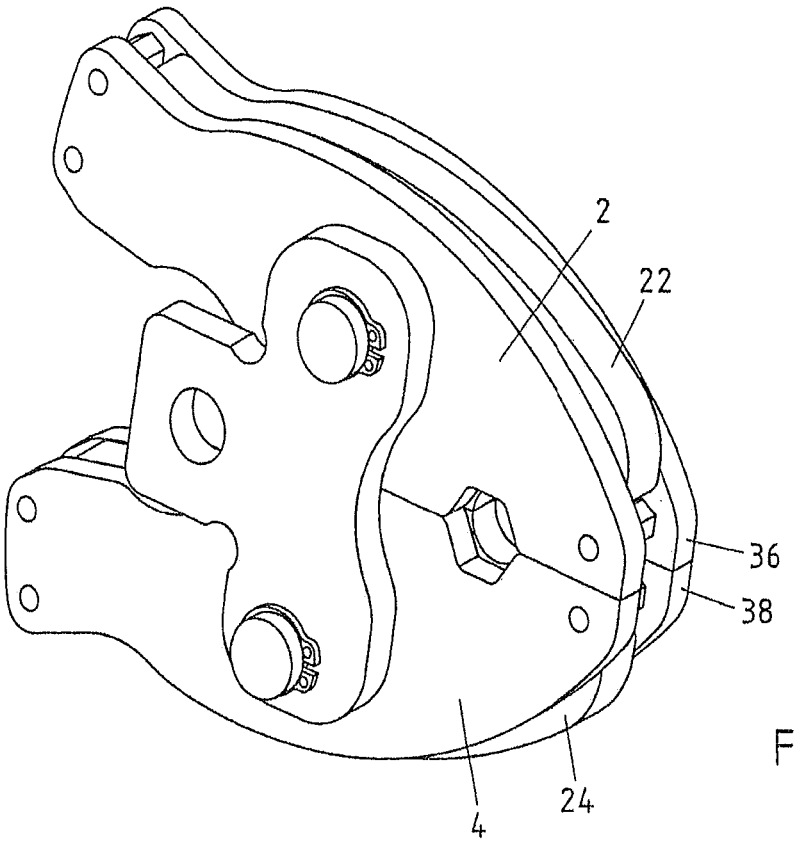
Figure 10:
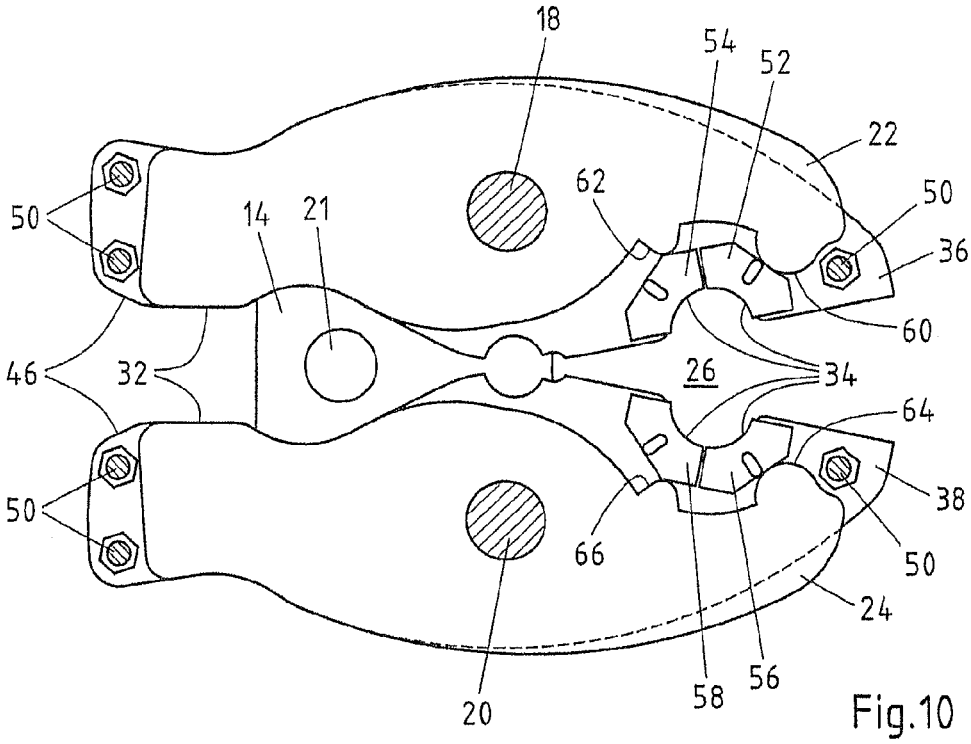
Figure 11:
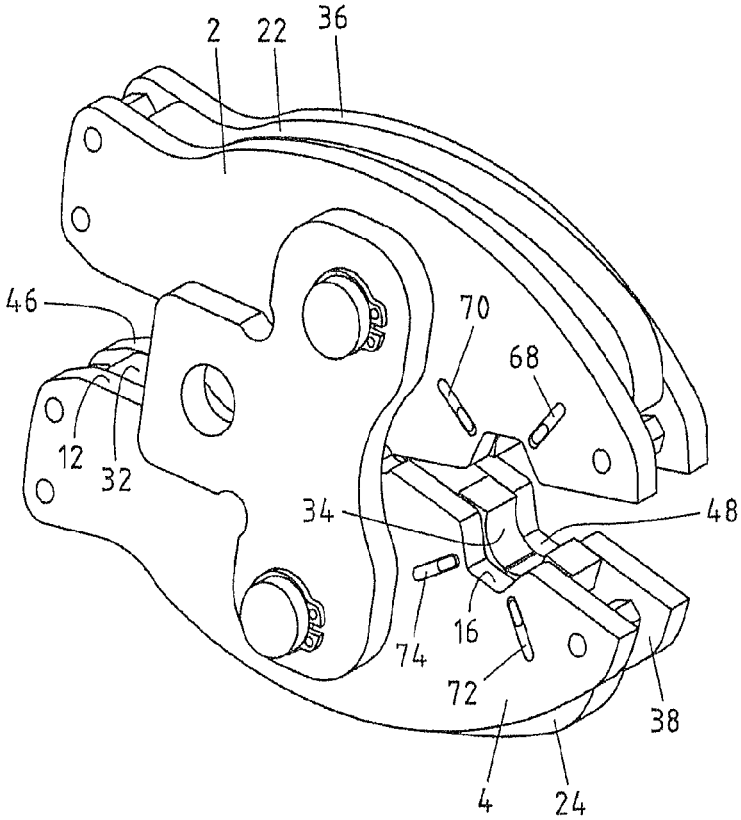
Figure 12:
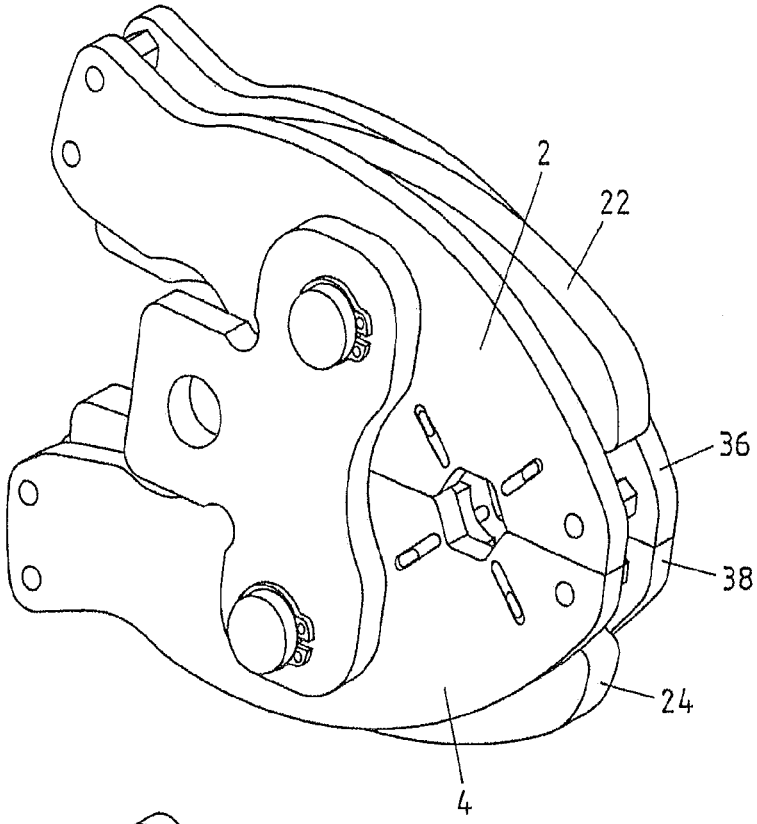
Figure 13:
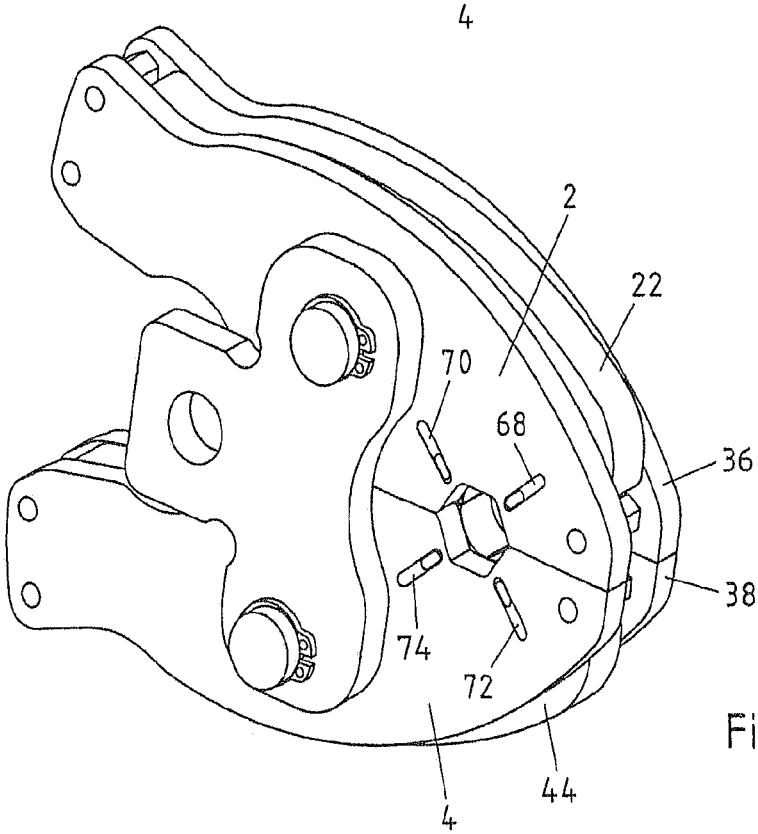
Figure 14:
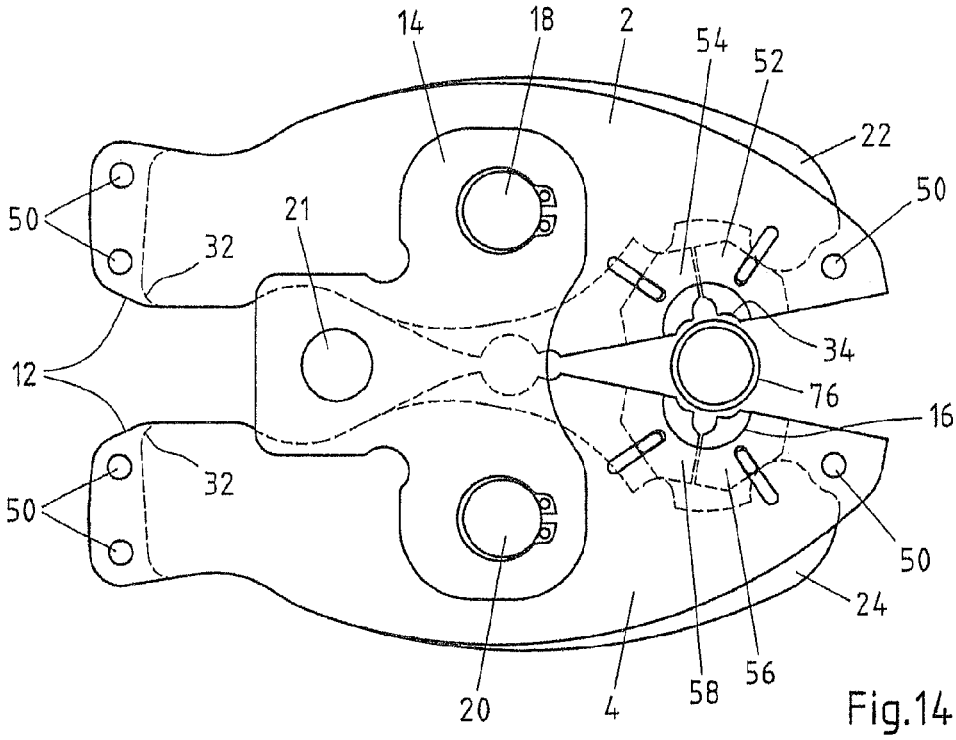
Figure 15:
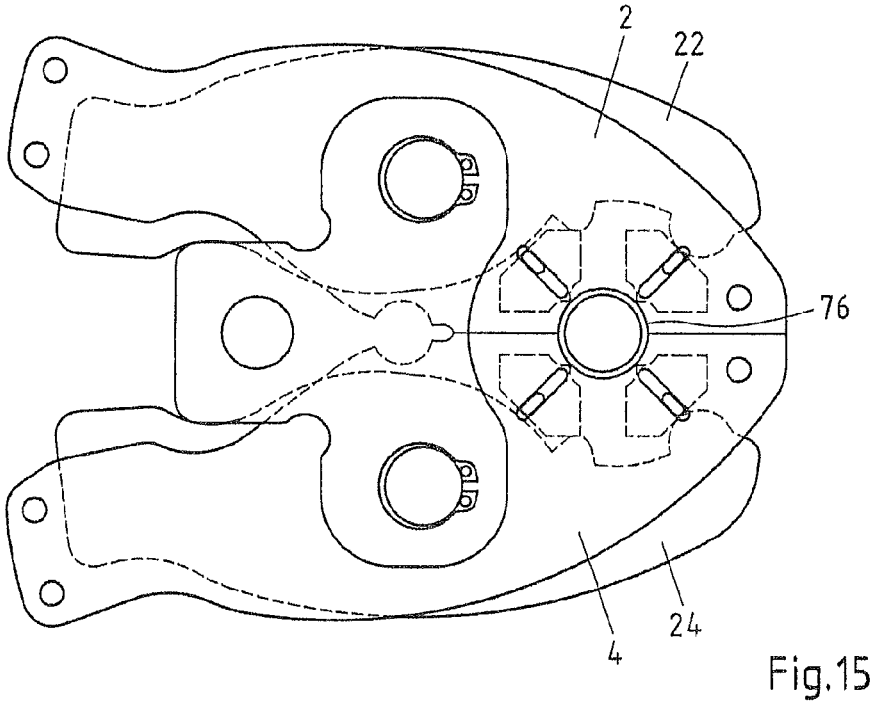
Figure 16:
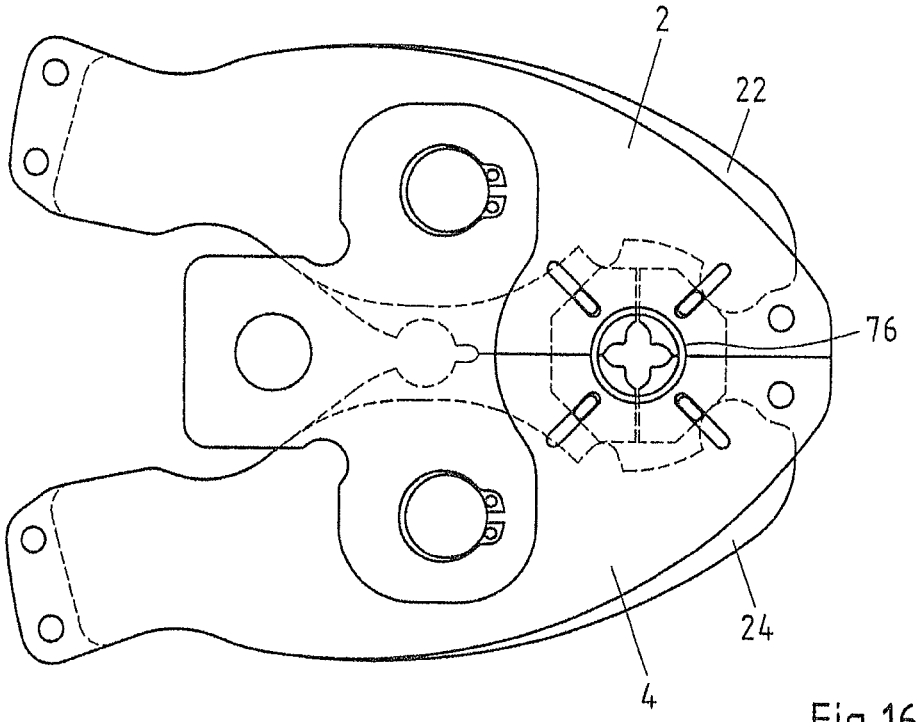

FIG. 3 shows an exemplary embodiment of the tool having the pairs of jaws from FIGS. 1 and 2, in a side view, FIG. 4 shows the exemplary embodiment from FIG. 3 in a perspective view, FIG. 5 shows the exemplary embodiment from FIG. 4, in which the pair of jaws is closed, FIG. 6 shows the exemplary embodiment from FIG. 4, in which the first and second pair of jaws are closed, FIG. 7 shows an exemplary embodiment having a first, second and third pair of jaws in the open state, FIG. 8 shows the exemplary embodiment from FIG. 7, in which the first and third pair of jaws are closed, FIG. 9 shows the exemplary embodiment from FIG. 7, in which the first, second and third pair of jaws are closed, FIG. 10 shows an exemplary embodiment having a first, second and third pair of jaws and tool elements for pressing in the open state, in which only the second and third pair of jaws and the tool elements are illustrated in a side view, FIG. 11 shows the exemplary embodiment from FIG. 10 having a first, second and third pair of jaws and tool elements for pressing in the open state, in a perspective view, FIG. 12 shows the exemplary embodiment from FIG. 11, in which the first and third pair of jaws are closed, FIG. 13 shows the exemplary embodiment from FIG. 11, in which the first, second and third pair of jaws are closed, FIG. 14 shows an exemplary embodiment having a first, second and third pair of jaws and tool elements for cutting in the open state with a workpiece, in a side view, FIG. 15 shows the exemplary embodiment from FIG. 14, in which the first and third pair of jaws are closed and FIG. 16 shows the exemplary embodiment from FIG. 14, in which the first, second and third pair of jaws are closed.

For the sake of clarity, not all reference symbols were repeated in all figures, even if the corresponding features can be identified in the figures.

FIG. 1 shows a first pair of jaws 2, 4 which has a first upper jaw 2 and a first lower jaw 4, having a first effective area 6 formed between the front ends of the first jaws 2, having a first inlet contour 12 formed between the rear ends 8, 10 of the first jaws 2, 4 and having a holding device 14 which movably accommodates the first jaws 2, 4 independent of one another, wherein the first jaws 2, 4 are in an open position but can be pivoted in a pivoting plane A. The pivoting plane A is in this case the plane drawn in FIG. 1. Due to the three-dimensional extension of the jaws, a pivoting plane will be understood to be a plane which runs through the jaws or abuts on them. In this exemplary embodiment, the first effective contour 16 has a hexagonal shape. The holding device 14 furthermore has an upper pin 18 for the first upper jaw 2 and a lower pin 20 for the first lower jaw 4. It is, of course, also possible for just one pin to be used for both jaws 2, 4.

The holding device 14 is preferably designed so that it accommodates the jaws 2, 4 on both sides, thus also from the rear side (behind the image plane in FIG. 1), and the pins 18 and 20 are accommodated a second time, in order to achieve better stability.

The holding device 14 preferably also has a holder 21, for example in the form of a hole, in order to fix the tool between the inlet contours by means of the press when the bolt is introduced.

FIG. 2 shows a second pair of jaws 22, 24 which has a second upper jaw 22 and a second lower jaw 24, wherein a second effective area 26 is formed between the front ends of the second jaws 22, 24, wherein a second inlet contour 32 is formed between the rear ends 28, 30 of the second jaws 22, 24, wherein the holding device 14 movably accommodates the second jaws 22, 24 independent of one another, wherein the second jaws (22, 24) are in an open position and can be pivoted in the pivoting plane B (drawing plane). The holding device 14 furthermore has an upper pin 18 for the second upper jaw 22 and a lower pin 20 for the second lower jaw 24. The second inlet contour 32 is formed differently from the first inlet contour 12. The second effective contour 34 is cylindrical in shape. The effective contours 16, 34 from FIGS. 1 and 2 are suitable in this case for pressing the workpiece 76.

FIG. 3 now shows a side view of an exemplary embodiment according to the invention, in which the first jaws 2, 4 in front of the second jaws 22, 24 are jointly arranged in a holding device 14. Both pairs of jaws are open and have the effective contours 16, 34 from FIGS. 1 and 2. The second jaws 22, 24 can move independently of the first jaws 2, 4. Owing to the different inlet contours 12, 32, in the present exemplary embodiment when a bolt from a press (not illustrated, coming from the left in FIG. 3) is inserted, firstly the first jaws 2, 4 and then the second jaws 22, 24 are closed. This process is illustrated in the following FIGS. 4 to 6.

Here, FIG. 4 shows the exemplary embodiment from FIG. 3 in a perspective view. The jaws 2, 4, 22, 24 are open.

FIG. 5 now shows the tool closing process at the point at which the first pair of jaws 2, 4 is already closed and the second pair of jaws 22, 24 is still open.

FIG. 6 now shows the completed tool closing process. That is to say, both the first pair of jaws 2, 4 and the second pair of jaws 22, 24 are closed.

FIG. 7 shows a third pair of jaws 36, 38 which has a third upper jaw 36 and a third lower jaw 38, wherein a third effective area 40 is formed between the front ends of the third jaws 36, 38, wherein a third inlet contour 46 is formed between the rear ends 42, 44 of the third jaws 36, 38, wherein the holding device 14 movably accommodates the third jaws 36, 38 independent of one another and in principle independent of the first jaws 2, 4 and the second jaws 22, 24, wherein all jaws are in an open position. The third jaws 36, 38 can be pivoted in a pivoting plane C running through the third jaws 36, 38, wherein the third inlet contour 46 is formed differently from the second inlet contour 32 but is identical to the first inlet contour 12. The second pair of jaws 22, 24 is arranged between the first pair of jaws 2, 4 and third pair of jaws 36, 38.

Here, the third effective contour 48 of the third jaws 36, 38 is identical to the first effective contour 16. The first jaws 2, 4 and third jaws 36, 38 are fixedly connected to one another via connecting elements 50, for example screws or pins.

FIG. 8 shows the tool closing process at the point at which the first jaws 2, 4 and third jaws 36, 38 are already closed but the second jaws 22, 24 are still open. An inserted tool 76 would now be processed, in this case pressed, in the first effective area 6 in the plane A and in the third effective area 40 in the plane C.

FIG. 9 now shows the tool closing process at the point at which both the first jaws 2, 4 and third jaws 36, 38 and also the second jaws 22, 24 are already closed.

FIG. 10 shows an exemplary embodiment having a first pair of jaws 2, 4, a second pair of jaws 22, 24 and a third pair of jaws (not illustrated) and four tool elements 52, 54, 56, 58 for pressing in the open state, in which only the second pair of jaws 22, 24, the third pair of jaws 36, 38 and the tool elements 52, 54, 56, 58 are illustrated in a section of a side view. Here, the four tool elements 52, 54, 56, 58 are characterised in that in each case a front tool element 52 and a rear tool element 54 are in contact with the second upper jaw 22 and in each case a front tool element 56 and a rear tool element 58 are in contact with the second lower jaw 24, and in that the tool elements 52, 54, 56, 58 take part in the movement of the second jaws 22, 24. In this case, the second pair of jaws 22, 24 is not integrally formed with the effective contour. This is because the second effective area 26 and the second effective contour 34 are defined by the tool elements. In addition, the second jaws 22, 24 have a bump 60, 62, 64, 66 for each tool element 52, 54, 56, 58. The bumps enable the tool elements 52, 54, 56, 58 to apply force on the workpiece 76 at essentially the same time and a typical shear movement is reduced or even prevented. The second effective contour 34 is in this case a cylindrical pressing contour.

FIG. 11 shows the exemplary embodiment from FIG. 10 with open jaws 2, 4, 22, 24, 36, 38 in a perspective view. In addition, the holders 68, 70, 72, 74 of the first jaws 2, 4 are illustrated, in which the tool elements 52, 54, 56, 58 partly engage. Preferably, holders are also present in the third jaws 36, 38. The holders 68, 70, 72, 74 formed as slots here serve as a guide rail for the tool elements 52, 54, 56, 58.

FIG. 12 shows the exemplary embodiment from FIG. 11. The tool closing process can be seen at the point at which the first jaws 2, 4 and third jaws 36, 38 are already closed but the second jaws 22, 24 are still open. An inserted workpiece 76 would now be processed in the first effective area 6 and in the third effective area 40, in this case hexagonally pressed.

FIG. 13 now shows the tool closing process at the point at which both the first jaws 2, 4 and third jaws 36, 38 and also the second jaws 22, 24 are already closed. The tool elements 52, 54, 56, 58 have followed the movement of the second jaws along the holders 68, 70, 72, 74 and would cylindrically press an inserted workpiece 76 in the second effective area 26.

FIG. 14 shows an exemplary embodiment similar to the one from FIGS. 11 to 13 in the open state, in a side view. The tool elements 52, 54, 56, 58 in this case are formed with a second effective contour 34 which in this exemplary embodiment is formed in such a way that it is suitable for cutting. Of course, it is also possible for the tool elements 52, 54, 56, 58 to have different effective contours. As illustrated in the following figures, an inserted workpiece 76 is firstly held by means of the first jaws 2, 4 and third jaws 36, 38 and then cut through by means of the second jaws 22, 24 and the cutting tool elements 52, 54, 56, 58.

FIG. 15 shows, due to the different inlet contours 12, 32, 46 of the jaws, how firstly the first jaws 2, 4 and third jaws 36, 38 are closed. Since the first effective contour 6 and the third effective contour 48 essentially correspond to the circumferential contour of the workpiece 76, this workpiece 76 is held with a positive-fit or frictionally engaged or even fixed.

FIG. 16 now shows the completed processing operation from FIGS. 14 and 15. The second jaws 22, 24 are also closed and the tool elements 52, 54, 56, 58 were formed so far into the workpiece 76 that in this case it was completely severed.

The invention claimed is:

1. A tool for processing a workpiece, comprising
- a first pair of jaws, having a first front ends and a first rear ends, which has a first upper jaw and a first lower jaw,
- a first effective area formed between the first front ends of the first jaws,
- a first inlet contour formed between the first rear ends of the first jaws and
- a holding device which movably accommodates the first jaws independent of one another,
- wherein the first jaws can be pivoted between an open position and a closed position,
- wherein a second pair of jaws, having a second front ends and a second rear ends, is provided which has a second upper jaw and a second lower jaw,
- wherein a second effective area is formed between the second front ends of the second jaws,
- wherein a second inlet contour is formed between the second rear ends of the second jaws,
- wherein the holding device movably accommodates the second jaws independent of one another and independent of the first jaws,
- wherein the second jaws can be pivoted between an open position and a closed position, and
- wherein the first inlet contour and the second inlet contour are formed differently.

2. The tool according to claim 1, wherein a first effective contour and a second effective contour are formed differently.

3. The tool according to claim 1, wherein each pairs of jaws are arranged offset relative to each other, and each pairs of jaws are configured to perform effects on areas along a workpiece to be inserted.

4. The tool according to claim 1, wherein the holding device has at least two pins, wherein a first pin is a common pivot pin for the upper jaws and a second pin is a common pivot pin for the lower jaws.

5. The tool according to claim 1, wherein at least one pair of jaws is integrally formed with an effective contour, which forms one of the first effective area and the second effective area.

6. The tool according to claim 1,
- wherein a third pair of jaws, having a third front ends and a third rear ends, is provided which has a third upper jaw and a third lower jaw,
- wherein a third effective area is formed between the third front ends of the third jaws,
- wherein a third inlet contour is formed between the third rear ends of the third jaws, wherein the holding device movably accommodates the third jaws independent of one another and independent of the first jaws and the second jaws, wherein the third jaws can be pivoted between an open position and a closed position, and wherein the third inlet contour is formed differently from the first inlet contour or from the second inlet contour, and wherein the second pair of jaws is arranged between the first pair of jaws and the third pair of jaws.

7. The tool according to claim 6, wherein each case the first upper jaw and third upper jaw and first lower jaw and third lower jaw are fixedly connected to one another via connecting elements.

8. The tool according to claim 7, wherein the first pair of jaws and the third pair of jaws have the same inlet contour.

9. The tool according to claim 6, wherein at least four tool elements are provided, in that in each case a front tool element and a rear tool element are in contact with the second upper jaw and in each case a front tool element and a rear tool element are in contact with the second lower jaw, and in that the tool elements take part in the movement of the second jaws.

10. The tool according to claim 9, wherein the first jaws and/or third jaws have holders for the tool elements, wherein the tool elements can move relative to the jaws and relative to one another.

11. The tool according to claim 9, wherein at least one second jaw has at least one for each tool element.

12. The tool according to claim 11, wherein the bumps of the second jaws apply a force to the tool elements essentially at the same time.

13. The tool according to claim 1, wherein at least one effective contour is a pressing contour.

14. The tool according to claim 1, wherein at least one effective contour is a holding contour and at least one effective contour is a cutting contour, wherein each of the at least one effective contours form one of the first effective area and the second effective area.

15. The tool according to claim 1, wherein at least two effective contours are identical.

* * * * *

UNITED STATES PATENT AND TRADEMARK OFFICE

CERTIFICATE OF CORRECTION

PATENT NO. : 8,578,751 B2
APPLICATION NO. : 13/289583
DATED : November 12, 2013
INVENTOR(S) : Frank Hofmann It is certified that error appears in the above-identified patent and that said Letters Patent is hereby corrected as shown below:

In the Claims

Column 10, Line 9, Claim 11, after "one" insert -- bump --

Signed and Sealed this
Fourth Day of March, 2014

Michelle K. Lee

Michelle K. Lee
*Deputy Director of the United States Patent and Trademark Office*